US008511865B2

(12) United States Patent
Tu et al.

(10) Patent No.: US 8,511,865 B2
(45) Date of Patent: Aug. 20, 2013

(54) LED LUMINAIRE LIGHT REDIRECTION SHIELD

(75) Inventors: Chin-Wang Tu, Cupertino, CA (US); Shih Chang Wang, Chung Ho (TW); Pin-Hao Hsu, Yang Mei (TW); Yi-Kai Cheng, Taipei (TW)

(73) Assignee: Leotek Electronics Corporation, Lung-Tan, Tao-Yuan County (TW)

( * ) Notice: Subject to any disclaimer, the term of this patent is extended or adjusted under 35 U.S.C. 154(b) by 50 days.

(21) Appl. No.: 13/103,752

(22) Filed: May 9, 2011

(65) Prior Publication Data

US 2012/0008320 A1 Jan. 12, 2012

Related U.S. Application Data

(60) Provisional application No. 61/333,172, filed on May 10, 2010.

(51) Int. Cl.
*F21V 7/00* (2006.01)

(52) U.S. Cl.
USPC ..... 362/342; 362/228; 362/279; 362/249.02; 362/292

(58) Field of Classification Search
USPC ..... 362/228, 231, 279, 280, 290–293, 362/341, 342
See application file for complete search history.

(56) References Cited

U.S. PATENT DOCUMENTS

| | | | |
|---|---|---|---|
| 4,013,915 | A | 3/1977 | Dufft |
| 4,298,869 | A | 11/1981 | Okuno |
| 4,419,722 | A | 12/1983 | Bury |
| 4,507,718 | A | 3/1985 | Bury |
| 4,682,147 | A | 7/1987 | Bowman |
| 4,868,719 | A | 9/1989 | Kouchi |
| 4,887,074 | A | 12/1989 | Simon et al. |
| 4,974,353 | A | 12/1990 | Norfolk |
| 5,040,320 | A | 8/1991 | Reidinger |
| 5,066,889 | A | 11/1991 | Edwards |
| 5,388,357 | A | 2/1995 | Malita |
| 5,410,453 | A | 4/1995 | Ruskouski |
| 5,416,679 | A | 5/1995 | Ruskouski et al. |
| 5,428,912 | A | 7/1995 | Grondal et al. |
| 5,459,955 | A | 10/1995 | Ruskouski et al. |

(Continued)

FOREIGN PATENT DOCUMENTS

JP 10-322053 4/1998

OTHER PUBLICATIONS

Quantum Lamps, Ameratech R&D Inc. & Leotek Inc. product information sheet, 2 pages, Pub. Feb. 1992.

(Continued)

*Primary Examiner* — Ali Alavi

(74) *Attorney, Agent, or Firm* — DLA Piper LLP (US)

(57) ABSTRACT

An LED lamp that includes a housing forming an open cavity, a plurality of LEDs configured to produce a light output disposed in the cavity, a lens disposed over the LEDs for focusing and/or diffusing the light output, and a redirection shield disposed in the cavity. The redirection shield includes a base plate with a plurality of apertures formed therein, and a plurality of shielding plates extending from a top surface of the base plate. The LEDs extend through the apertures. The shielding plates block a portion of the light output such that an overall light distribution of the light output from the LED lamp is asymmetric.

29 Claims, 6 Drawing Sheets

(56) References Cited

U.S. PATENT DOCUMENTS

| | | | | |
|---|---|---|---|---|
| 5,463,280 | A | 10/1995 | Johnson | |
| 5,526,236 | A | 6/1996 | Burnes et al. | |
| 5,561,346 | A | 10/1996 | Byrne | |
| 5,593,223 | A | 1/1997 | Koizumi | |
| 5,632,551 | A | 5/1997 | Roney | |
| 5,655,830 | A | 8/1997 | Ruskouski | |
| 5,688,042 | A | 11/1997 | Madadi et al. | |
| 5,726,535 | A | 3/1998 | Yan | |
| 5,729,925 | A | 3/1998 | Prothero | |
| 5,742,120 | A | 4/1998 | Lin | |
| 5,890,794 | A | 4/1999 | Abtahi et al. | |
| 5,939,996 | A | 8/1999 | Kniveton | |
| 6,048,082 | A | 4/2000 | Washimoto | |
| 6,158,156 | A | 12/2000 | Patrick | |
| 6,481,130 | B1 | 11/2002 | Wu | |
| 6,502,956 | B1 | 1/2003 | Wu | |
| 6,536,913 | B1 | 3/2003 | Yajima et al. | |
| 6,558,021 | B2 | 5/2003 | Wu | |
| 6,598,998 | B2 | 7/2003 | West et al. | |
| 6,674,096 | B2 | 1/2004 | Sommers | |
| 6,761,471 | B2 | 7/2004 | Wu | |
| 7,172,324 | B2 | 2/2007 | Wu | |
| 2006/0018122 | A1 | 1/2006 | Negley | |
| 2009/0290360 | A1 | 11/2009 | Wilcox et al. | |
| 2010/0110671 | A1 * | 5/2010 | Gordin et al. | 362/228 |

OTHER PUBLICATIONS

Maintenance-Free L.E.D. Exit Sign, Leotek Electronics Corporation product information sheet, 2 pages, Pub. 1995.

Leotek Lamps, Leotek Electronics Corporation product information sheet, 2 pages, Pub. Aug. 1996.

Leotek Open Signs, Leotek Electronics Corporation product information sheet, 2 pages, Pub. 1996.

Astralite 2000, Astralite product information sheet, 2 pages, Pub. 1994.

T6.5 Ultra Lite, Halco Lighting Corporation product information sheet, 1 page, Pub. 1995.

Redhead LED Exit Lamp, TCP product information sheet, 1 page, Pub. 1995.

E-Z Lamp, Isolite Corp. product information sheet, 2 pages, Pub. 1995.

Exbrite Exit Retrofit, Conservalite Technologies, Inc. product information sheet, 1 page, Pub. Apr. 1996.

Bright Idea, Standard Enterprises, Inc., product information sheet, 2 pages, Pub. Mar. 1996.

Universal T Lamp, Area Lighting Research, Inc. product information sheet, 2 pages, Pub. Apr. 1996.

Wattman LED Exit Retrofit Lamp, Standard Enterprises Inc., product information sheet, 2 pages, Pub. 1995.

International Search Report and Written Opinion of the International Search Authority; dated Aug. 22, 2011, in the corresponding PCT application PCT/US2011/035848.

* cited by examiner

LED LUMINAIRE LIGHT REDIRECTION SHIELD

RELATED APPLICATIONS

This application claims the benefit of U.S. Provisional Application No. 61/333,172, filed May 10, 2010, and which is incorporated herein by reference.

FIELD OF THE INVENTION

The present invention relates to LED luminaries, and more particularly to an LED luminaire design incorporating an optical shielding element for preventing or reducing the distribution of light in at least one direction.

BACKGROUND OF THE INVENTION

The light distribution emitted from a typical light emitting diode (LED) is Lambertian, which means the highest light intensity is directly above the emitting surface of the LED. In typical lighting applications such as street lights, multiple LEDs are mounted on a flat surface all facing downwardly toward the street. If the Lambertian LED light emission pattern is not modified by an additional optical component, most of the light intensity is directed directly below the street light luminaire onto the street, thus generating an unwanted hot spot under the luminaire and minimal light directed to the area around the street light. For most street light applications, there is a wide target area of illumination that extends beyond the hot spot that would be directly underneath the luminaire. Consequently, a wider and more uniform illumination distribution on the street or other desired illuminated areas can be difficult to achieve.

Secondary lenses mounted over the LEDs are often used to more uniformly redistribute the light emitted from the LEDs so that the adjacent target area around the LED luminaire is better illuminated (e.g. in order to meet various IESNA light distribution criteria for the street lighting or other area lighting applications). However, in certain applications, it may be desired to selectively exclude a portion of the adjacent area around the luminaire from the distribution of light. For example, in residential street light applications, many times street lights are positioned adjacent to houses, where a substantially uniform distribution of the light over a large target area causes too much light to be directed toward adjacent homes. Rather, it is desired that the street light illuminate the street and sidewalks of the target area, but reach not much further toward an adjacent home where it would interfere with the privacy of the residents. Asymmetric secondary lenses could be used to redirect some of the light away from an adjacent home, but such lenses are difficult and expensive to implement, and provide only limited success in preventing light from being directed into an adjacent area while still maintaining the desired uniform (or substantially uniform) distribution of light in the remaining portions of the target area.

There is a need for an LED luminaire that efficiently and reliably produces the desired illumination of light in an adjacent around the luminaire with the ability to selectively reduce or eliminate illumination of light in one portion of that adjacent area without adversely affecting the distribution of light elsewhere.

BRIEF SUMMARY OF THE INVENTION

The aforementioned needs are addressed by an LED lamp that includes a redirection shield and a plurality of LEDs. The redirection shield that includes a base plate with a plurality of apertures formed therein, and a plurality of shielding plates extending from a top surface of the base plate. The plurality of LEDs are configured to produce a light output and extend through the apertures, wherein the shielding plates block a portion of the light output such that an overall light distribution of the light output from the LED lamp is asymmetric.

The LED lamp can include a housing forming an open cavity, a plurality of LEDs configured to produce a light output disposed in the cavity, a lens disposed over the LEDs, and a redirection shield disposed in the cavity. The redirection shield includes a base plate with a plurality of apertures formed therein, and a plurality of shielding plates extending from a top surface of the base plate. The LEDs extend through the apertures. The shielding plates block a portion of the light output such that an overall light distribution of the light output from the LED lamp is asymmetric.

Other objects and features of the present invention will become apparent by a review of the specification, claims and appended figures.

BRIEF DESCRIPTION OF THE DRAWINGS

FIG. 3 is a perspective view of the redirection shield and LEDs extending there through.

FIG. 4 is a top view of the redirection shield and LEDs extending there through.

FIG. 5 is a perspective view of the redirection shield and LEDs extending there through.

DETAILED DESCRIPTION OF THE INVENTION

Figure 1:
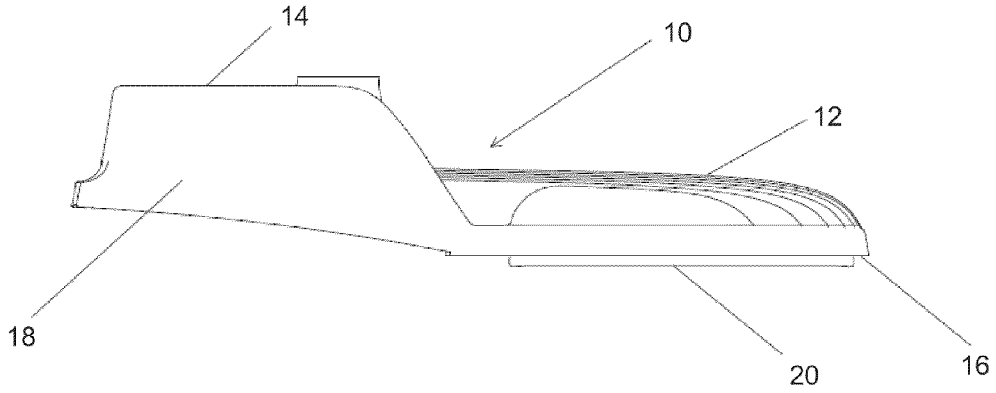
FIG. 1 is a side view of a street lamp housing suitable for the present invention.

The present invention is an LED luminaire that utilizes a redirection shield assembly to reduce or eliminate the illumination of an area to one side of the luminaire. FIG. 1 illustrates one embodiment of the present invention in the form of an overhead street luminaire 10. It should be understood, however, that while the present invention is described with respect to an overhead street luminaire (with LEDs mounted facing downwardly to illuminate the street, sidewalk and/or other ground areas below and around the luminaire), that the present invention is not limited to this particular luminaire application and/or a downwardly facing orientation of the LEDs.

Street luminaire 10 includes a housing with an LED portion 12 and an electronics portion 14. The LED portion 12 includes an open ended cavity 16 containing the LEDs, and the electronics portion 14 includes a cavity 18 containing electronics for supplying power to and controlling the LEDs. A lens 20 is disposed over the LEDs, and preferably (but not necessarily) has optical focusing and/or diffusion properties that create the desired light distribution in the target illumination area below. Lens 20 is optional, and could be a single lens element or a plurality of separate lens elements mounted or aligned to each other.

LEDs are conventionally mounted on a flat substrate (usually a printed circuit board that provides electrical power and mechanical support for the LEDs). The power supply for the LEDs can be mounded on the printed circuit board or supplied separately. LEDs, their supporting substrate, and their power supplies are well known in the art, and are not further described herein.

Figure 2:
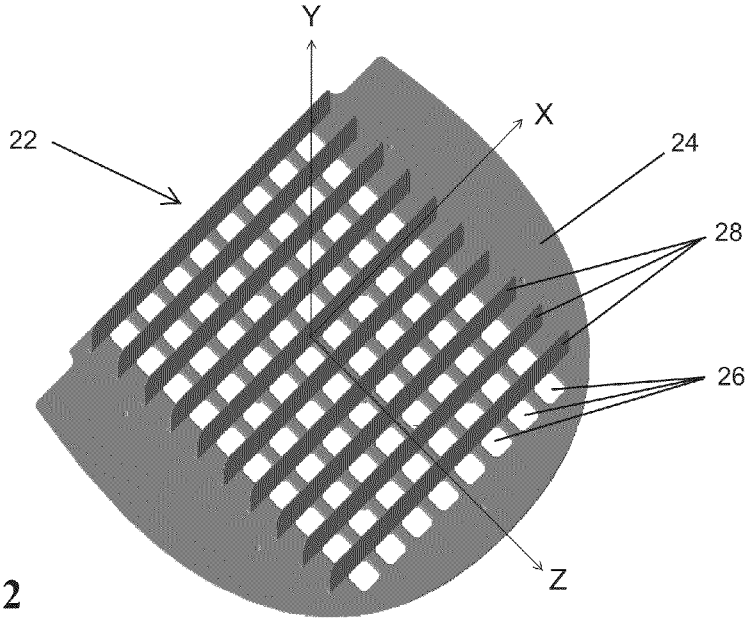
FIG. 2 is a perspective view of the redirection shield.
Figure 3:
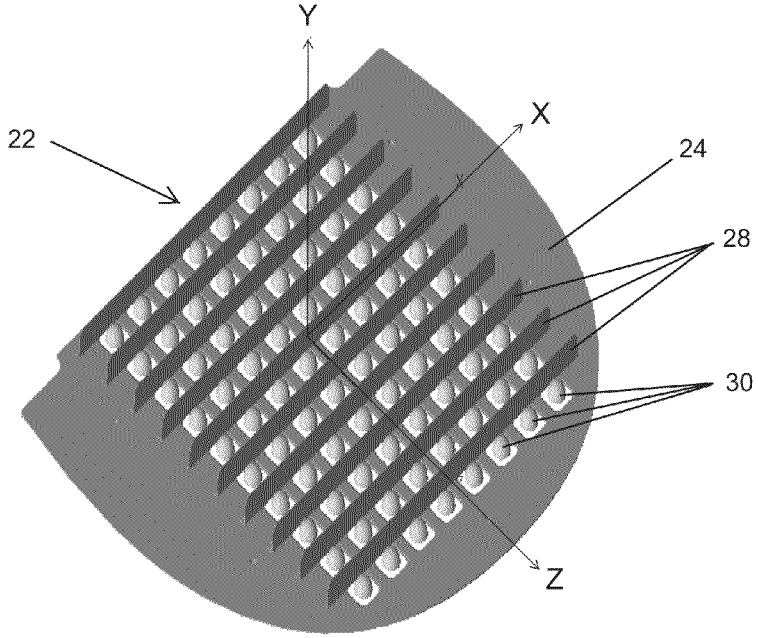
Figure 4:
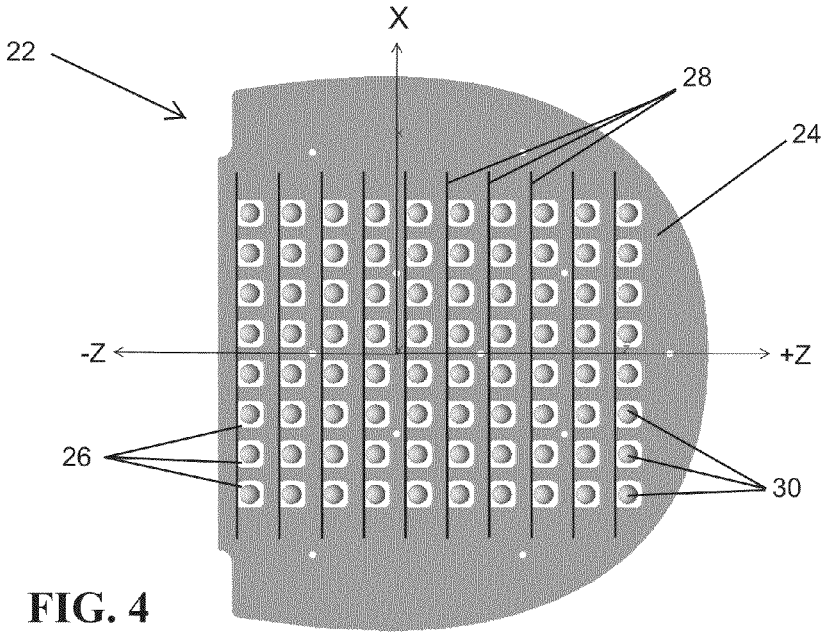
Figure 5:
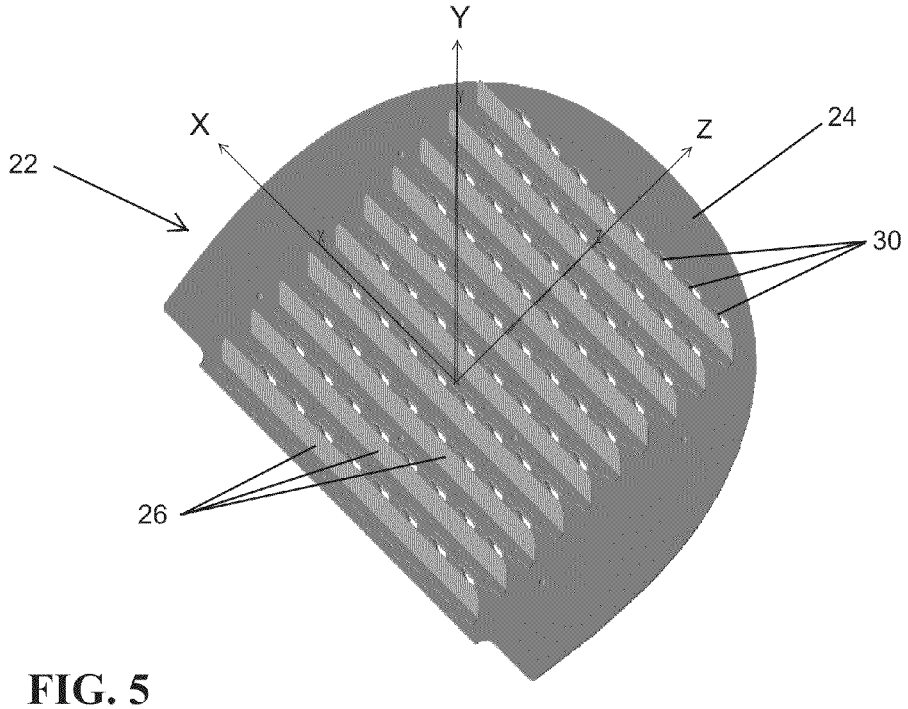
Figure 6:
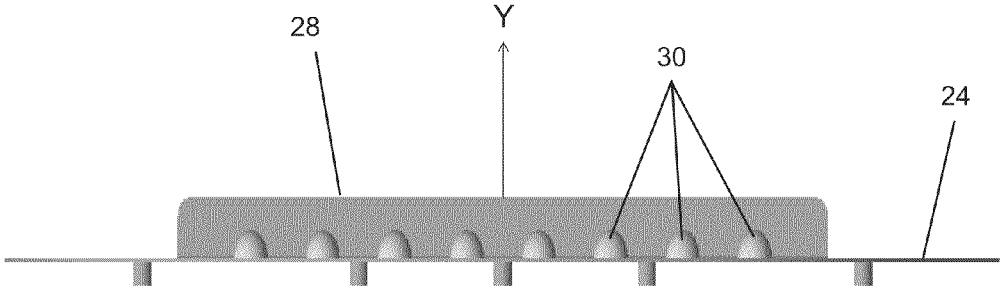
FIG. 6 is a side view of the redirection shield and LEDs extending there through illustrating a single row of LEDs and their associated shielding plate.
Figure 7:
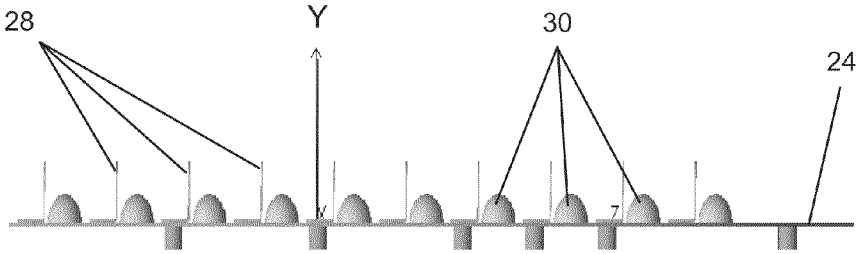
FIG. 7 is a side view of the redirection shield and LEDs extending there through illustrating a rows of LEDs and their associated shielding plates.

FIGS. 2-7 illustrate the redirection shield 22 of the present invention. Shield 22 includes a base plate 24, a plurality of apertures 26 formed in the base plate 24, and a plurality of shielding plates 28 extending from the top surface of the base plate 24. The apertures 26 are configured such that when the base plate 24 is positioned over the supporting substrate of the LEDs, the LEDs 30 extend through the apertures 26, as illustrated in FIG. 3. The apertures 26 can be formed as individual openings as illustrated (one for each LED 30), or as continuous open slots or other shapes for accommodating multiple LEDs (e.g. an entire row or column of LEDs 30 extending through a single aperture 26, or a group or cluster of LEDs extending through a single aperture, etc.).

In the embodiment illustrated in FIGS. 2 and 3, the LEDs 30 and matching apertures 26 are arranged in rows and columns (in the indicated X and Z directions respectively). The shielding plates 28 extend from the base plate 24 in the indicated Y direction, and extend between adjacent rows of apertures 26. In order to selectively reduce the light directed in one direction (e.g. the negative-Z direction [−Z] as shown in the figures) to produce an asymmetrical light output, the shielding plates 28 are preferably but not necessarily disposed closer to one row of apertures (and therefore the row of LEDs extending there through) than the adjacent row. Preferably, but not necessarily, the shielding plates abut the edges of one row of apertures (i.e. the −Z side of the apertures), while being spaced further away from the +Z side of the adjacent row of apertures. This configuration will result in the shielding plates 28 blocking (e.g. absorbing or reflecting) light emitted at lower angles in the −Z direction than same low angle emission in the +Z direction, as explained further below. In addition to or instead of placing the shielding plates closer to one row of apertures, depending on the desired degree of containment, different shapes and different dimensions of the shielding plate can be chosen for different degrees of light distribution reduction in the desired direction(s), and those shapes and dimensions can even vary between shielding plates on the same redirection shield.

Figure 8A:
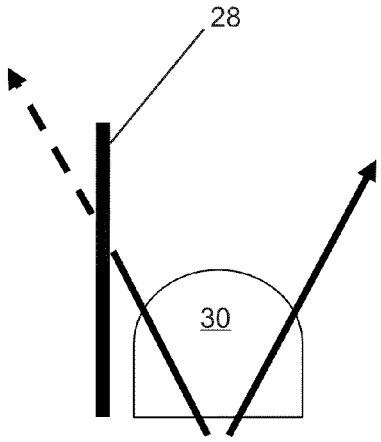
FIG. 8A is a side view of an LED and its associated shielding plate, illustrating the shielding plate blocking/absorbing emitted light.
Figure 8B:
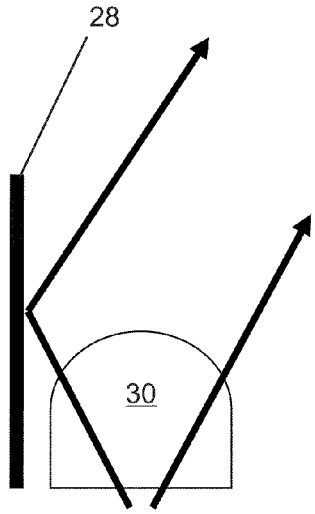
FIG. 8B is a side view of an LED and its associated shielding plate, illustrating the shielding plate reflecting emitted light.

The shielding plates 28 can be made of or coated with a light absorbing material (e.g. black paint, black anodization, etc.) to absorb the blocked light. FIG. 8A illustrates two light rays emitted by the LED at the same angle but in opposite directions. The shielding plate adjacent the LED blocks and absorbs the light ray in one direction, while the light exiting in the other direction at the same angle is unaffected. Alternately, the shielding plates can be made of or coated with a reflective material, so that the blocked light is reflected back toward the other direction, as illustrated in FIG. 8B.

Figure 9A:
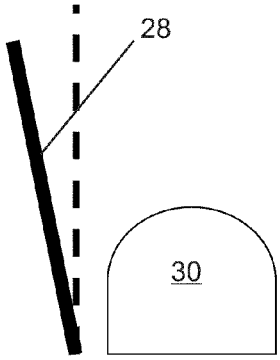
FIGS. 9A-9C are side views of an LED and its associated shielding plate, illustrating various tilting angles at which the shielding plate can be disposed.
Figure 9B:
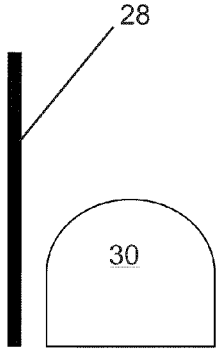
Figure 9C:
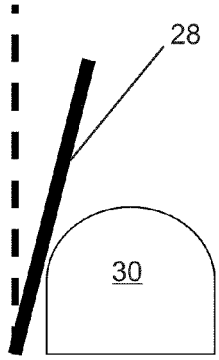
Figure 10A:
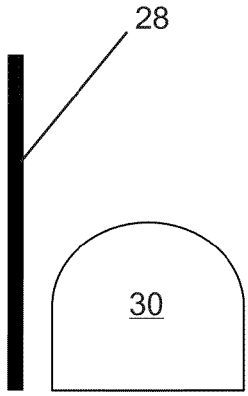
FIGS. 10A-10D are side views of an LED and its associated shielding plate, illustrating various exemplary possible shapes of the shielding plate.
Figure 10B:
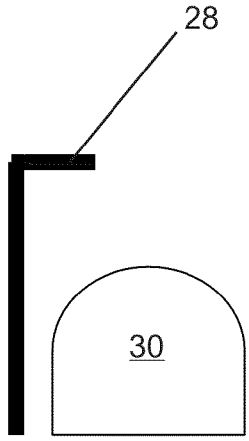
Figure 10C:
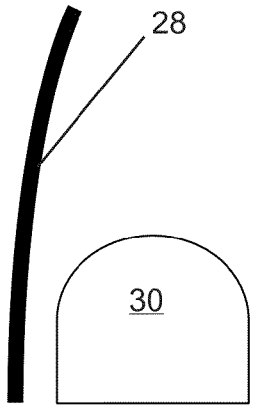
Figure 10D:
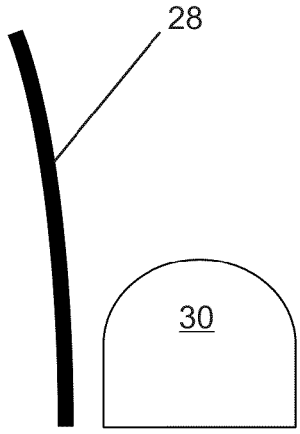

To achieve the desired light blocking affect in the one direction, the shield plates 28 can extend vertically (FIG. 9B), lean away from the LED (FIG. 9A), or lean toward the LED (FIG. 9C). Additionally, the shield plates 28 can have various shapes, such as planar (FIG. 10A), L-shape (FIG. 10B), concave (FIG. 10C) or convex (FIG. 10D), in order to provide the desired light blocking affect. The light distribution can also be affected by changing the distance between the LED and the shielding plate for that row of LEDs, and/or the shielding plate for the adjacent row of LEDs. It should be noted that it is usually desired, but not required, to have at least some of the light from every LED in the lamp blocked by a shielding plate (i.e. some LEDs could be disposed where substantially none of their output is blocked by a shielding plate).

The amount and character of light blocked by the various shielding plates in the same luminaire can vary (i.e. by varying the dimensions, shapes and locations of the various shielding plates in the same luminaire). For example, depending on the lens 20 being used (if one is used), some LEDs near the −Z edge of the LED array may have less or no light blocking by a shielding plate 28 (e.g. because the housing edge can act as a partial shield, the lens 20 being used more effectively diverts light from those LEDs than others in the array, etc.), while other LEDs in the center or near +Z edge of the LED array can have more light blocking via shielding plates 28 (e.g. lens 20 less effective in diverting light away from −Z direction). In this manner, the redirection shield 22 can be custom configured for the luminaire design, and the particular location with its associated desired illumination pattern. Moreover, the redirection shield 22 can be easily added to an existing luminaire to solve an illumination problem discovered after the luminaire was installed, and/or be replaced by a redirection shield 22 optimized for a different illumination pattern if a change is desired (i.e. a house is newly built and needs shielding from light that was previously tolerable). The light distribution can also be affected by adjusting the height of the base plate 24 relative to the LEDs (i.e. mount the base plate 24 in an adjustable manner so that the height of the shielding plates 28 relative to the LEDs 30 can be varied to vary the light blocking characteristics of the redirection shield 22). The asymmetric nature of the resulting light distribution can be in one direction relative to an opposite direction (i.e. block or reduce light heading toward an adjacent house but not light extending toward the street in the opposite direction), and/or in opposite directions relative to orthogonal opposite directions (i.e. block or reduce light heading toward adjacent houses on both sides of the street in favor of not blocking/reducing light as much extending in orthogonal directions that extend down the length of the street).

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. While the base plate is shown as being planar, it need not be if the LEDs are disposed in an array that is not planar. While the shielding plates are shown as continuous strips extending along an entire row of LEDs, they can be discontinuous, and even can be configured as separate individual shields each for a single LED.

What is claimed is:

1. An LED lamp, comprising:

a redirection shield that includes:

a base plate with a plurality of apertures formed therein in the form of spaced apart continuous open elongated slots, and a plurality of shielding plates extending from a top surface of the base plate; and a plurality of LEDs configured to produce a light output and extending through the apertures such that multiple ones of the plurality of LEDs extend through each of the continuous open elongated slots, wherein each of the shielding plates is adjacent to and blocks a portion of the light output directly from a multitude of the plurality of LEDs such that an overall light distribution of the light output from the LED lamp is asymmetric.

2. The LED lamp of claim 1, wherein the shielding plates are configured with a light absorptive material that blocks the light output portion by light absorption.

3. The LED lamp of claim 1, wherein the shielding plates are configured with a light reflecting material that blocks the light output portion by light reflectivity.

4. The LED lamp of claim 1, wherein:

the LEDs are arranged in a plurality of rows and columns.

5. The LED lamp of claim 4, wherein the shielding plates extend from the top surface of the base plate in an orthogonal manner.

6. The LED lamp of claim 4, wherein for each of the rows of LEDs, one of the shielding plates extends from the top surface of the base plate and along the row of LEDs, and leaning toward the LEDs of the row.

7. The LED lamp of claim 4, wherein for each of the rows of LEDs, one of the shielding plates extends from the top surface of the base plate and along the row of LEDs, and leaning away from the LEDs of the row.

8. The LED lamp of claim 4, wherein each of the rows of LEDs extends through one of the continuous open elongated slots.

9. The LED lamp of claim 4, wherein each of the columns of LEDs extends through one of the continuous open elongated slots.

10. The LED lamp of claim 1, wherein at least one of the shielding plates extends from the top surface of the base plate in a concave or convex manner.

11. The LED lamp of claim 1, wherein one of the shielding plates varies in dimension or shape relative to another one of the shielding plates.

12. The LED lamp of claim 1, wherein the shielding plates are configured to asymmetrically block the light output from the LEDs.

13. The LED lamp of claim 1, wherein at least one of the shielding plates extends from the top surface of the base plate in a planar manner.

14. The LED lamp of claim 1, wherein at least one of the shielding plates has an L-shape that extends up and partially over at least one of the rows of the LEDs.

15. An LED lamp, comprising:

a housing forming an open cavity;

a plurality of LEDs configured to produce a light output disposed in the cavity;

a lens disposed over the LEDs; and a redirection shield disposed in the cavity that includes:

a base plate with a plurality of apertures formed therein in the form of spaced apart continuous open elongated slots, and a plurality of shielding plates extending from a top surface of the base plate, wherein the LEDs extend through the apertures such that multiple ones of the plurality of LEDs extend through each of the continuous open elongated slots, and wherein each of the shielding plates is adjacent to and blocks a portion of the light output directly from a multitude of the plurality of LEDs such that an overall light distribution of the light output from the LED lamp is asymmetric.

16. The LED lamp of claim 15, wherein:

the LEDs are arranged in a plurality of rows and columns.

17. The LED lamp of claim 16, wherein the shielding plates extend from the top surface of the base plate in an orthogonal manner.

18. The LED lamp of claim 16, wherein for each of the rows of LEDs, one of the shielding plates extends from the top surface of the base plate and along the row of LEDs, and leaning toward the LEDs of the row.

19. The LED lamp of claim 16, wherein for each of the rows of LEDs, one of the shielding plates extends from the top surface of the base plate and along the row of LEDs, and leaning away from the LEDs of the row.

20. The LED lamp of claim 16, wherein each of the rows of LEDs extends through one of the continuous open elongated slots.

21. The LED lamp of claim 16, wherein each of the columns of LEDs extends through one of the continuous open elongated slots.

22. The LED lamp of claim 15, wherein at least one of the shielding plates extends from the top surface of the base plate in a concave or convex manner.

23. The LED lamp of claim 15, wherein one of the shielding plates varies in dimension or shape relative to another one of the shielding plates.

24. The LED lamp of claim 15, wherein the lens focuses or diffuses the light output.

25. The LED lamp of claim 15, wherein the shielding plates are configured to asymmetrically block the light output from the LEDs.

26. The LED lamp of claim 15, wherein the shielding plates are configured with a light absorptive material that blocks the light output portion by light absorption.

27. The LED lamp of claim 15, wherein the shielding plates are configured with a light reflecting material that blocks the light output portion by light reflectivity.

28. The LED lamp of claim 15, wherein at least one of the shielding plates extends from the top surface of the base plate in a planar manner.

29. The LED lamp of claim 15, wherein at least one of the shielding plates has an L-shape that extends up and partially over at least one of the rows of the LEDs.

* * * * *